US005510886A

United States Patent [19]

Sugimoto et al.

[11] Patent Number: 5,510,886

[45] Date of Patent: Apr. 23, 1996

[54] IMAGE FORMING APPARATUS HAVING AN INTERMEDIATE IMAGE CARRIER

[75] Inventors: Hiroyuki Sugimoto, Tokyo; Miki Kai, Yokohama; Makoto Arai, Tokyo, all of Japan

[73] Assignee: Ricoh Company, Ltd., Tokyo, Japan

[21] Appl. No.: 221,670

[22] Filed: Apr. 1, 1994

[30] Foreign Application Priority Data

| | | | |
|---|---|---|---|
| Apr. 3, 1993 | [JP] | Japan | 5-100516 |
| May 18, 1993 | [JP] | Japan | 5-138994 |
| May 19, 1993 | [JP] | Japan | 5-140214 |

[51] Int. Cl.[6] ..... G03G 15/14

[52] U.S. Cl. ..... 355/273; 355/271; 355/272

[58] Field of Search ..... 355/271, 272, 355/273, 277, 296, 297, 299, 306; 346/74.2

[56] References Cited

U.S. PATENT DOCUMENTS

| | | | |
|---|---|---|---|
| 3,717,409 | 2/1973 | Hepenheide | 355/298 |
| 4,380,385 | 4/1983 | Ozaki et al. | 355/277 |
| 4,831,386 | 5/1989 | Cherbuy et al. | 346/74.2 |
| 4,984,026 | 1/1991 | Nishise et al. | 355/277 |
| 5,053,827 | 10/1991 | Tompkins et al. . | |
| 5,182,598 | 1/1993 | Hara et al. | 355/271 X |
| 5,237,374 | 8/1993 | Ueno et al. | 355/299 |
| 5,343,277 | 8/1994 | Rooijakkers et al. | 355/271 |

*Primary Examiner*—Sandra L. Brase

*Attorney, Agent, or Firm*—Oblon, Spivak, McClelland, Maier & Neustadt

[57] ABSTRACT

An image forming apparatus having a photoconductive element or similar image carrier, and an intermediate transfer belt or similar intermediate image carrier to which a toner image is transferred from the image carrier. A lubricating oil additive whose major component is zinc stearate is melted and then solidified by cooling to form a flat plate-like agent. The agent is transformed to fine particles and applied to the surface of the intermediate transfer belt to eliminate toner filming on the belt. The agent also serves to enhance the parting ability of the belt surface, thereby insuring efficient image transfer from the belt to a recording medium. The surfaces of the photoconductive element, belt and recording medium are so conditioned as to satisfy a predetermined relation with respect to the coefficient of friction.

25 Claims, 6 Drawing Sheets

IMAGE FORMING APPARATUS HAVING AN INTERMEDIATE IMAGE CARRIER

BACKGROUND OF THE INVENTION

The present invention relates to an image forming apparatus of the type having a photoconductive element or similar image carrier, and an intermediate transfer belt or similar intermediate image carrier to which a toner image is transferred from the image carrier and, more particularly, to an implementation for eliminating toner filming on the intermediate image carrier and defective image transfer which degrade image quality.

It is a common practice with a copier, facsimile apparatus, printer or similar image forming apparatus, particularly a color image forming apparatus, to use an intermediate image carrier implemented as, for example, an intermediate transfer belt. In this type of apparatus, after a toner image has been transferred from the belt to a final recording medium, e.g., paper sheet, some toner is left on the belt as well as on a photoconductive element or similar image carrier. Therefore, the belt has to be cleaned to remove the remaining toner before the next image forming cycle begins. A device for cleaning the belt or the photoconductive element has customarily been implemented by a cleaning blade made of, for example, urethan rubber or a fur brush. Particularly, the device using a cleaning blade is extensively used since it is simple in mechanical arrangement and low cost.

However, the problem with the blade cleaning scheme is that as toner particles melted by heat and pressure and fine toner particles adhere to the surface of the belt, the blade cannot fully remove them alone, causing a toner filming layer to sequentially grow on the belt. The filming layer lowers the image transfer ability of the apparatus and, therefore, degrades image quality. Particularly, since image transfer is effected at least twice before the transfer of a toner image to a paper sheet or similar final recording medium, even a thin filming layer is apt to lower the transfer efficiency of the apparatus to a noticeable degree. On the other hand, when use is made of a counter blade type cleaning device, it is likely that the filming layer on the belt increases the relative coefficient of friction between the belt and the cleaning blade, thereby causing the blade to be entrained by the belt.

In light of the above, Japanese Patent Laid-Open Publication No. 2-214882 discloses a device having a cleaning roller downstream of a cleaning blade and causing it to rub the surface of an intermediate image carrier, thereby removing a filming layer. Further, Japanese Patent Laid-Open Publication No. 2-262180 proposes an improvement over the Laid-Open Publication No. 2-214882, i.e., a device having means for supporting the cleaning roller such that the roller is movable into and out of contact with the surface of the intermediate image carrier; every time image formation is repeated a predetermined number of times, the roller is brought into contact with the image carrier. Japanese Patent Laid-Open Publication N. 3-65973 teaches the use of fine particles of lubricating oil additive, although it does not pertain to the intermediate image carrier. The fine particles of lubricating oil additive are applied to the surface of a transfer drum which supports a paper sheet, thereby forming a film on the drum. This film reduces the surface energy of the transfer drum to promote the removal of a toner from the surface of the drum.

However, the device taught in the Laid-Open Publication No. 2-214882 has a drawback that the cleaning roller is apt to rub the surface of the intermediate image carrier excessively. Regarding the device of the Laid-Open Publication No. 2-262 180, although the cleaning roller is periodically brought into contact with the intermediate image carrier, the device cannot fully adapt to the environment since the growth of the filming layer depends on, among others, the conditions in which the image forming apparatus is used.

On the other hand, in a color image forming apparatus of the type having an intermediate image carrier, materials constituting an image carrier, intermediate image carrier and recording medium have to be adequately selected in respect of coefficient of friction; otherwise, defective image transfer is apt to occur. For example, so long as an image is transferred from a surface having a small coefficient of friction to a surface having a great coefficient of friction, the transfer is successful. However, when an image is transferred from the latter surface to the former surface, defective image transfer, i.e., local omission of a character image is likely to occur.

SUMMARY OF THE INVENTION

It is, therefore, an object of the present invention to provide an image forming apparatus capable of eliminating toner filming on an intermediate image carrier to which a toner image is transferred from an image carrier.

It is another object of the present invention to provide an image forming apparatus of the type having an intermediate image carrier and capable of reducing defective image transfer for thereby enhancing image quality.

In accordance with the present invention, an image forming apparatus comprises an image carrier for carrying a toner image formed by developing a corresponding latent image, an intermediate image carrier for carrying the toner image transferred from the image carrier, a first image transferring device for transferring the toner image from the image carrier to the intermediate image carrier, a second image transferring device for transferring the toner image from the intermediate image carrier to one of a final toner image carrier and another intermediate image carrier, a cleaning device for removing a toner remaining on the intermediate image carrier, and an applying device for applying to the surface of the intermediate image carrier fine particles capable of preventing toner filming from occurring.

Also, in accordance with the present invention, an image forming apparatus comprises an image carrier rotatable for forming a toner image on the surface thereof, and an intermediate image carrier rotatable in contact with the image carrier for causing the toner image to be transferred from the image carrier to the surface of the intermediate image carrier at a position where the intermediate image carrier contacts the image carrier. The toner image on the intermediate image carrier is transferred to a recording medium. The image carrier, intermediate image carrier and recording medium have respective surfaces conditioned to satisfy a relation:

$$\alpha \leqq \beta \leqq \gamma$$

where $\alpha$ is a relative coefficient of friction between the image carrier and a body frictionally containing the image carrier, $\beta$ is a relative coefficient of friction between the intermediate image carrier and a body identical with the above-mentioned body, and $\gamma$ is a relative coefficient of friction between the recording medium and a body identical with the same body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
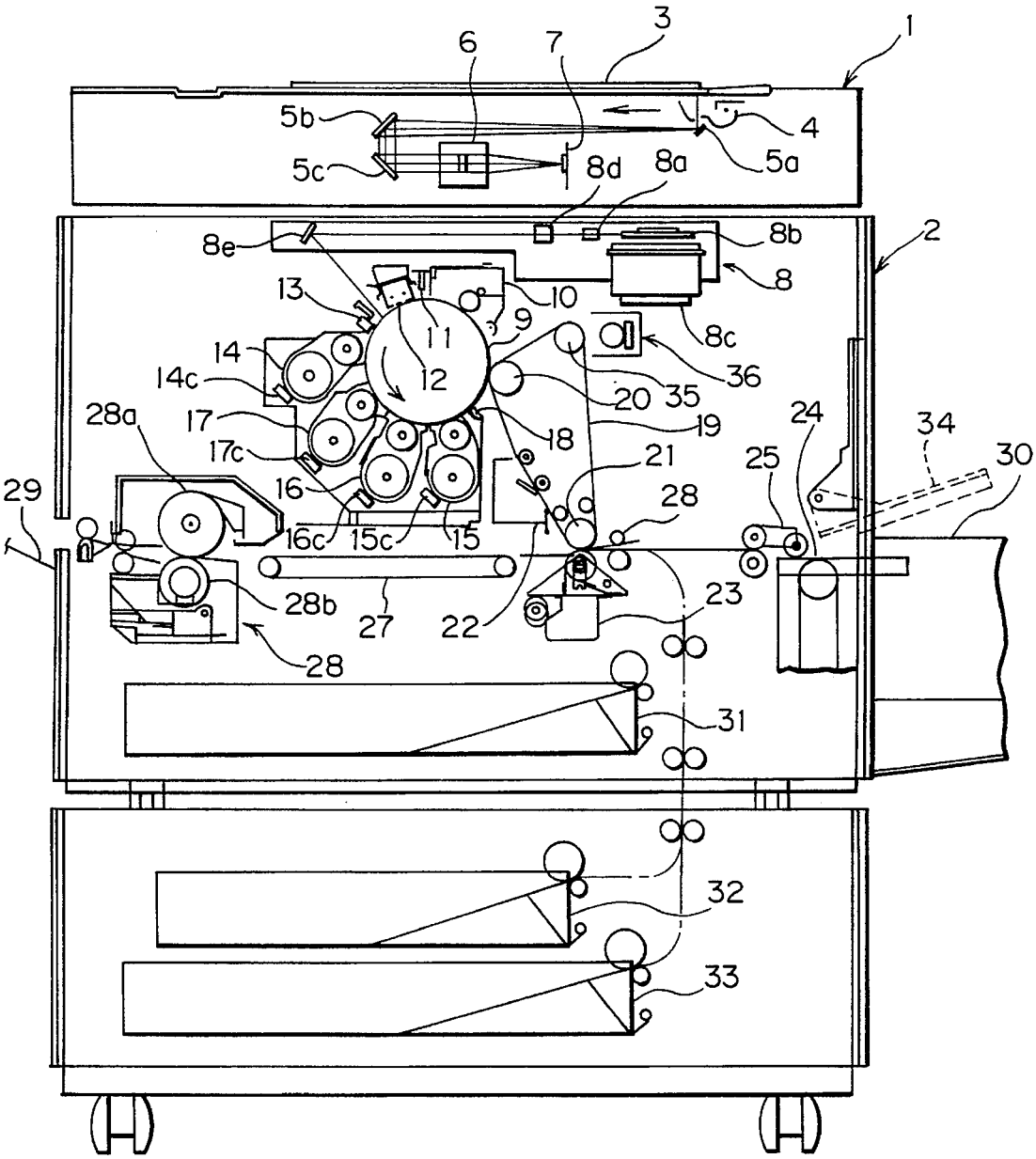
FIG. 1 is a section showing an image forming apparatus embodying the present invention and implemented as a color copier.

Referring to FIG. 1 of the drawings, an image forming apparatus embodying the present invention is shown and implemented as a color copier by way of example. As shown, the color copier has a color scanner 1 including a lamp 4. As the lamp 4 illuminates a document 3, the resulting reflection from the document 3 is focused onto a color image sensor 7 via mirrors 5*a*, 5*b* and 5*c* and a lens 6. The image sensor 7 reads the incident imagewise light in the form of, for example, blue (B), green (G) and red (R) color components and converts them to corresponding electric signals. An image processing section, not shown, processes the B, G and R image data on the basic of their intensity levels so as to produce black (Bk), cyan (C), magenta (M) and yellow (Y) color image data. A color image recording device, or color printer as referred to hereinafter, 2 prints out the color image data in Bk, C, M and Y one above another, thereby forming a full-color image.

Figure 2:
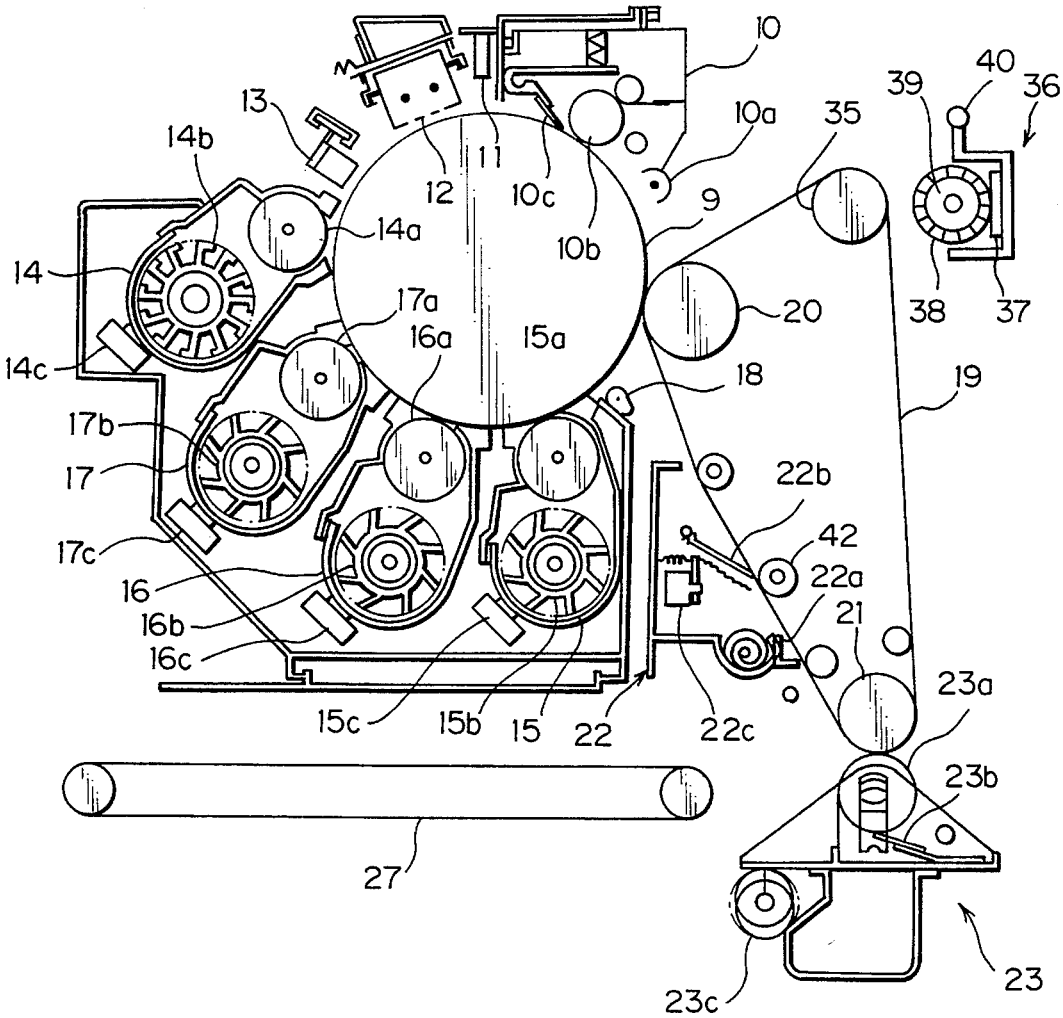
FIG. 2 is a section showing a specific arrangement of a photoconductive element and intermediate transfer belt included in the embodiment, together with various members surrounding them.

A reference will also be made to FIG. 2 for describing the color printer 2 specifically. As shown, the color image data from the scanner 1 is applied to an optical unit, or optics, 8. The optics 8 transforms the color image data to an optical signal and writes the image data on a photoconductive drum 9 with the optical signal. As a result, a latent image is electrostatically formed on the drum 9. The optics 8 includes a laser 8*a*, a section, not shown, for controllably driving the laser 8*a*, a polygonal mirror 8*b*, a motor 8*c* for rotating the mirror 8*b*, an f-theta lens 8*d*, and a mirror 8*e*. The drum 9 is rotatable counterclockwise, as indicated by an arrow in FIG. 1. Arranged around the drum 9 are a cleaning unit 10 (including a precleaning discharger 10*a*) for cleaning the drum 9, a discharge lamp 11, a charger 12, a potential sensor 13, a Bk developing unit 14, a C developing unit 15, an M developing unit 16, a Y developing unit 17, a photosensor 18 responsive to a development density pattern, and an intermediate image transfer unit including an intermediate transfer belt, or intermediate image carrier, 19. The developing units 14–17 respectively have developing sleeves 14*a*, 15*a*, 16*a* and 17*a*, paddles 14*b*, 15*b*, 16*b* and 17*b*, and toner concentration sensors 14*c*, 15*c*, 16*c* and 17*c*. The sleeves 14*a*–17*a* are each rotatable while holding a developer deposited thereon in contact with the drum 9. The paddles 14*b*–17*b* are each rotatable to scoop up and agitate the associated developer.

The operation of the printer 2 will be described on the assumption that it sequentially forms Bk, C, M and Y images in this order by way of example. At first, when the printer 2 is in a stand-by condition, all the developing units 14–17 are held inoperative, e.g., developers on the sleeves 14*a*–17*a* are held in their inoperative condition. On the start of a copying operation, the scanner 1 begins to read Bk image data at a predetermined timing. The Bk image data is written to the drum 9 by a laser beam to form a corresponding electrostatic latent image. The latent image derived from the Bk image data will be referred to as a Bk latent image hereinafter. This is also true with latent images associated with C, M and Y image data. The sleeve 14*a* of the Bk developing unit 14 starts rotating before the leading edge of the Bk latent image reaches the Bk developing position of the unit 14, thereby bringing a Bk developer, or toner, deposited thereon to an operative position. As a result, the Bk latent image is developed by the Bk toner to produce a corresponding toner image. As soon as the trailing edge of the Bk latent image moves away from the Bk developing position, the Bk developer is brought to an inoperative position. This is completed at least before the leading edge of a C latent image to follow arrives at the Bk developing position. To render the Bk developer inoperative, the sleeve 14*a* may be rotated in the opposite direction to the direction in which it is rotated during development. Alternatively, only the sleeve 14*a* or the whole developing unit 14 may be moved away from the drum 9.

The Bk toner image formed on the drum 9 is transferred to the intermediate transfer belt 19 which is rotating at the same speed as the drum 9. Let the image transfer from the drum 9 to the belt 19 be referred to as belt transfer for simplicity. For the belt transfer, a predetermined bias voltage is applied to a transfer bias roller 20 while the drum 9 and belt 19 are held in contact. The Bk, C, M and Y toner images sequentially formed on the drum 9 are transferred to the belt 19 one above another to form a four-color image. The four-color image is collectively transferred from the belt 19 to a paper sheet or similar recording medium 24. The intermediate image transfer unit including the belt 19 will be described specifically later.

After the Bk image forming process described above, the scanner 1 starts reading C image data at a predetermined timing with the result that a C latent image is formed on the drum 9 by a laser beam. After the trailing edge of the Bk latent image has moved away from the C developing position of the C developing unit 15 and before the leading edge of the C latent image arrives at the C developing position, the sleeve 15*a* of the unit 15 starts rotating to bring a C developer, or toner, to an operative position. As a result, the C latent image is developed by the C developer to produce a corresponding toner image on the drum 9. As the trailing edge of the C latent image moves away from the C developing position, the C developer on the sleeve 15*a* is brought to an inoperative position like the previously stated Bk developer. This is also completed before the leading edge of an M latent image to follow reaches the C developing position. An M latent image and a Y latent image are formed on the drum 9 and developed by respective developers in the same manner as the Bk and C latent images.

In the intermediate image transfer unit, the belt 19 is passed over a drive roller 21 and a plurality of driven rollers (represented by rollers 35 and 42 in the figures) as well as over the bias roller 20. A motor, not shown, controllably drives the belt 19, as will be described specifically later. A belt cleaning unit 22 is provided for cleaning the belt 19 and includes an inlet seal 22*a*, a rubber blade 22*b*, and a mechanism 22*c* for moving the inlet seal 22*a* and rubber blade 22*b* into and out of contact with the belt 19. The mechanism 22*c* maintains the inlet seal 22*a* and rubber blade 22*b* spaced apart from the belt 19 when the belt transfer of the second, third and fourth images is under way after the belt transfer of the first image, i.e., Bk image. A paper transfer unit 23 has a bias roller 23*a*, a roller cleaning blade 23*b* and a mechanism 23*c* for moving the bias roller 23*a* into and out of contact with the belt 19. Usually, the mechanism 23*c* maintains the bias roller 23*a* spaced apart from the belt 19. However, when the four-color image is to be transferred from the belt 19 to a paper sheet or similar recording medium 24, the mechanism 23*c* presses the bias roller 23*a* against the belt 19 with the intermediary of the paper sheet 24. At this instant, a predetermined bias voltage is applied to the bias roller 23*a*. The paper sheet 24 is fed by a pick-up roller 25 and a registration roller 26 such that the leading edge thereof meets the leading edge of the four-color image on the belt 19 at an image transfer position.

Three different systems are available for driving the belt 19 after the first or Bk toner image has been fully transferred to the belt 19, as follows. Any one of such systems may be used alone, or some of them may be combined in matching relation to a copy size from the copying speed standpoint.

Constant Speed Forward System (1) Even after the belt transfer of the Bk toner image, the belt 19 is driven forward at the same speed.

(2) A C toner image is formed on the drum 9 such that the leading edge thereof arrives at a belt transfer position, where the belt 19 contacts the drum 9, just when the leading edge of the Bk toner image on the belt 19 reaches the belt transfer position again. As a result, the C image is transferred to the belt 19 in accurate register with the Bk image.

(3) This is followed by M and Y image forming steps to complete a four-color image on the belt 19.

(4) After the belt transfer of the fourth or Y toner image, the belt 19 is continuously moved forward to transfer the composite color image to the paper sheet 24.

Skip Forward System (1) After the belt transfer of the Bk toner image, the belt 19 is moved away from the drum 9, caused to skip forward at high speed, restored to the initial speed on moving a predetermined distance, and again brought into contact with the belt 19.

(2) A toner image is formed on the drum 9 such that the leading edge thereof arrives at the belt transfer position just when the leading edge of the Bk toner image on the belt 19 reaches the belt transfer position again. As a result, the C image is transferred to the belt 19 in accurate register with the Bk image.

(3) This is followed by M and Y image forming steps to complete a four-color image on the belt 19.

(4) After the belt transfer of the fourth or Y toner image, the belt 19 is continuously moved forward to transfer the composite color image to the paper sheet 24.

Back-And-Forth (Quick Return) System (1) After the belt transfer of the Bk toner image, the belt 19 is moved away from the drum 9, brought to a stop, and then returned in the opposite direction at high speed such that the Bk image on the belt 19 runs by the belt transfer position in the opposite direction. Then, the belt 19 is brought to a stop on moving a predetermined distance.

(2) When the leading edge of a C toner image formed on the drum 9 reaches a predetermined position short of the belt transfer position, the belt 19 is again moved forward and brought into contact with the drum 9. The C image is transferred from the drum 9 to the belt 19 in accurate register with the Bk image.

(3) This is followed by M and Y image forming steps to complete a four-color image on the belt 19.

(4) After the belt transfer of the fourth or Y toner image, the belt 19 is moved forward without being returned to transfer the composite color image to the paper sheet 24.

After the composite color image has been transferred from the belt 19 to the paper sheet 24 by any of the above systems, the paper sheet 24 is conveyed to a fixing unit 28 by a transport unit 27. The fixing unit 28 fixes the toner image on the paper 24 with a heat roller 28*a*, which is controlled to a predetermined temperature, and a press roller 28*b*. Finally, the paper sheet 24 with the fixed toner image is driven out to a copy tray 29 as a full-color copy.

After such belt transfer, the drum cleaning unit 10, i.e., a cleaning roller 10*b* and a cleaning blade 10*c* clean the surface of the drum 9. The discharge lamp 11 uniformly discharges the surface of the drum 9. On the other hand, the cleaning unit 22 has the rubber blade 22*b* thereof pressed against the belt 19 by the mechanism 22*c*, thereby cleaning the surface of the belt 19.

In a repeat copy mode, after the first Y (fourth color) image process, the operation of the scanner 1 and the image formation on the drum 9 begin at a predetermined timing in order to effect the second Bk (first color) image process. Regarding the belt 19, after the transfer of the first composite color image to a paper sheet, the second Bk toner image is transferred to the area of the belt which has been cleaned by the rubber blade 22*b*. This is followed by the same procedure as with the first paper sheet.

Paper cassettes 30, 31, 32 and 33 are each loaded with paper sheets of particular size. When a desired paper size is entered on an operation panel, not shown, paper sheets are sequentially fed from designated one of the cassettes 30–33 toward the register roller 26. The reference numeral 34 designates a tray for allowing OHP (Over Head Projector) sheets and relatively thick sheets to be fed by hand.

The above description has concentrated on a four-color copy mode. In a three-color or two-color copy mode, the procedure described above will be effected a number of times corresponding to the number of designated colors and the number of copies. In a single color copy mode, one of the developing units 14–17 associated with the designated color is continuously operated until a desired number of copies have been produced. At this instant, the belt 19 is driven forward at high speed in contact with the drum 9. Also, the rubber blade 22*b* of the cleaning unit 22 is continuously held in contact with the belt 19.

Figure 3A:
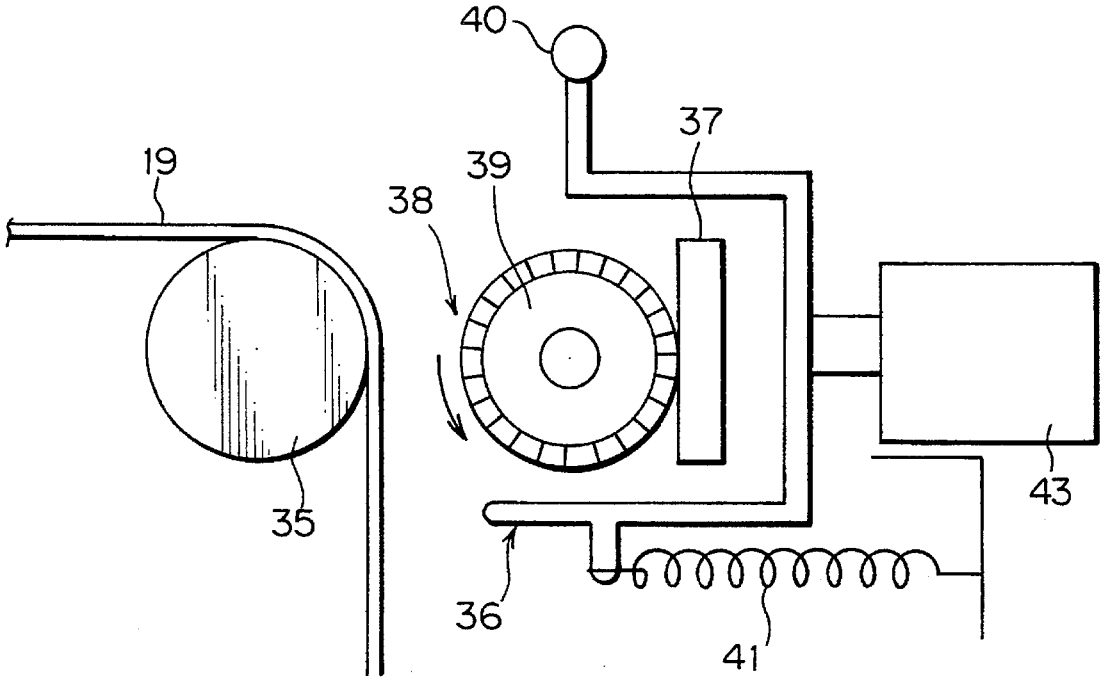
FIG. 3A is a section of an applying device included in the embodiment for applying a lubricating oil additive to the intermediate transfer belt.
Figure 3B:
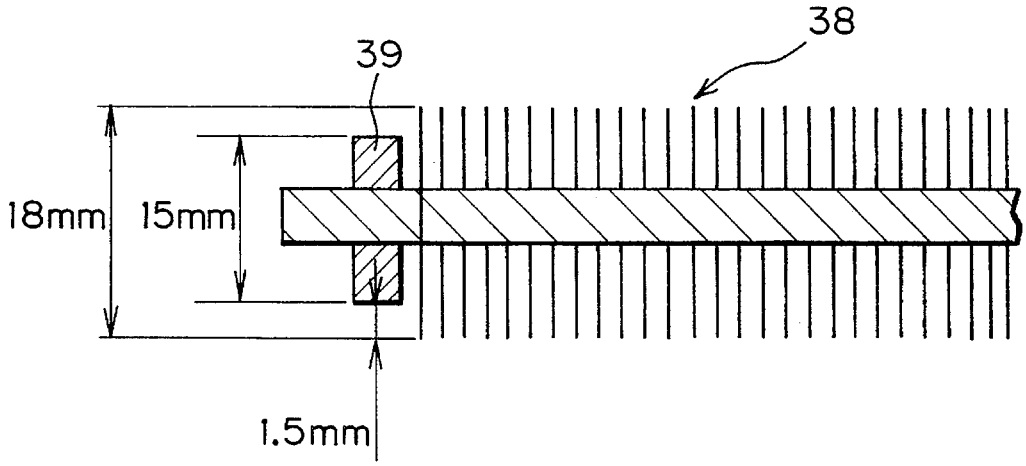
FIG. 3B is a vertical section of a brush roller included in the applying device of FIG. 3A.

Hereinafter will be described a device for applying fine particles to the belt 19 in order to eliminate toner filming. In the illustrative embodiment, a lubricating oil additive whose major component is fine particles of zinc stearate is melted and then solidified by cooling to prepare an agent to be applied to the belt 19. Specifically, as shown in FIG. 3A, an applying device 36 has a flat plate-like solidified agent, i.e., lubricating oil additive 37, a brush roller 38 held in contact with the agent 37, and a roller 39 for limiting the amount in which the brush roller 38 bites into the belt 19. FIG. 3B shows the brush roller 38 in a section. The brush roller 38 is rotatable counterclockwise, as viewed in FIG. 3A, driven by drive means, not shown. The applying device 36 is supported by the side walls of the apparatus body via a shaft 40. A solenoid or similar actuating means 43 moves the entire device 36 toward and away from the driven roller 35 associated with the belt 19, as needed. When the applying device 36 is not operated, a spring 41 maintains the brush roller 38 spaced apart from the belt 19. When the device 36 is operated, the solenoid 43 causes the entire device 36 to rotate about the shaft 40 until the brush roller 38 contacts the belt 19. At this instant, the brush roller 38 bites into the belt 19 until the rollers 39, which are mounted on opposite ends of the brush roller shaft, contact the surface of the belt 19 passed over the driven roller 35. In the embodiment, the brush 38 and the roller 39 are assumed to have outside diameters of 18 millimeters and 15 millimeters, respectively. Hence, the brush roller 38 is assumed to bite 1.5 millimeters into the belt 19. The brush 38 is implemented by filaments having a thickness of 300 deniers per forty-eight filaments, implanted in a density of 50,000 filaments per square inch, and having a length of 5 millimeters. The brush roller 38 and the agent 37 bite 1.5 millimeters into each other.

Since the agent 37 and brush roller 38 of the applying device 36 are constantly held in contact, the roller 38 rubs the surface of the agent 37 with the filaments thereof as soon as it starts rotating. Fine particles shaved off from the agent 37 by the brush roller 38 are uniformly deposited on the surface of the roller 38. In this condition, when the brush roller 38 is brought into contact with the belt 19, the fine particles are transferred from the roller 38 to the belt 19. Since the rollers 39 limit the amount in which the roller 38 bites into the belt 19, as stated above, the particles are uniformly applied to the belt 19 at all times.

By the above construction, the zinc stearate particles are applied to the belt 19 to free it from toner filming. In addition, such particles enhance the parting ability of the surface of the belt 19 and, therefore, prevents the image transfer rate from the belt 19 to a paper from decreasing.

Figure 4A:
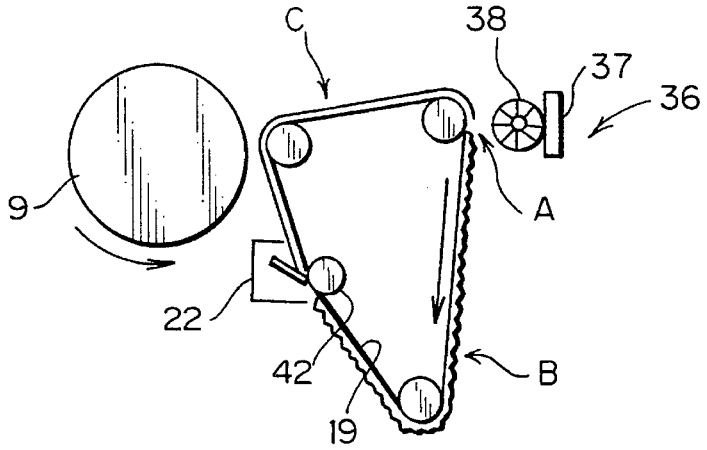
FIGS. 4A and 4B sections demonstrating the operation of the applying device of FIG. 3A.
Figure 4B:
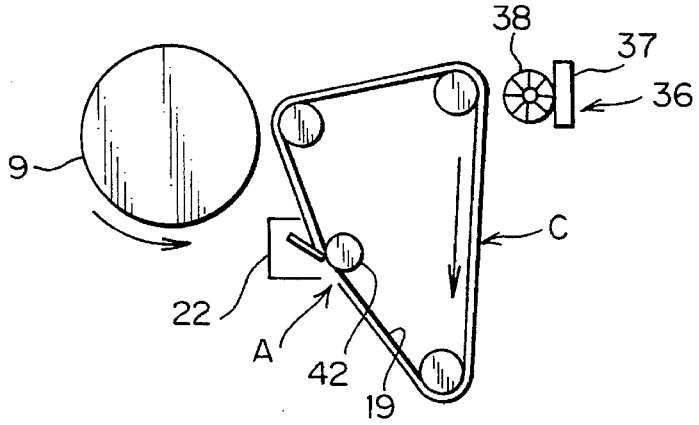

The operation of the applying device 36 will be described with reference to FIGS. 4A and 4B. At the end of a series of continuous copying cycles, the rubber blade **22*b* is brought into contact with the belt 19 which is in rotation, thereby starting on a cleaning operation. As soon as the position of the belt 19 cleaned first moves away from the applying device 36, the brush roller 38 is caused to start rotating and, at the same time, brought into contact with the belt 19 by the brush roller 38, thereby starting on an applying operation. On the elapse of a predetermined period of time (about 10 seconds, corresponding to about three rotations of the belt 19, in the embodiment), the solenoid 43 is deenergized to move the brush roller 38 away from the belt 19. Then, the rotation of the brush roller 38 is stopped. FIG. 4A shows a condition just after the brush roller 38 has been brought out of contact with the belt 19. In FIG. 4A, labeled A, B and C are respectively a belt portion facing the brush roller 38 at the instant when the brush roller 38 is moved away from the belt 19, a belt portion to which the fine particles have been applied, and a belt portion cleaned by the rubber blade 22*b*. Even after the brush roller 38 has been separated from the belt 19, the belt 19 is continuously rotated. Then, as shown in FIG. 4B, when the belt portion A moves away from the rubber blade 22*b*, the rotation of the belt 19 is stopped while the rubber blade 22*b* is moved away from the belt 19 (end of the applying and cleaning operations). For such control, a control section, not shown, selectively turns on or turns off the solenoids 22*c* and 43** and belt drive mechanism.

As stated above, the brush roller 38 is caused to contact only the area of the belt 19 which has been cleaned by the rubber blade **22*b*. This prevents the toner remaining on the belt 19 from depositing on the brush roller 38. Should the brush roller 38 be smeared by the remaining toner, it would fail to effectively apply the agent to the belt 19 and would cause the toner to fly away therefrom and contaminate the interior of the apparatus. Further, in the embodiment, the rubber blade 22*b* rubs the entire area of the belt 19 to which the agent has been applied by the brush roller 38. Why the rubber blade 22*b*** does so is as follows.

Figure 5:
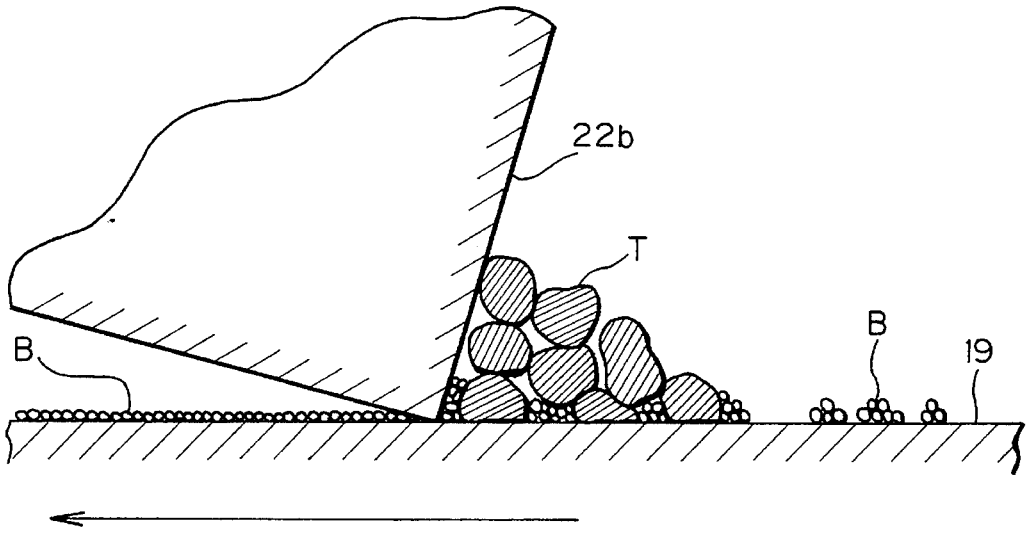
FIG. 5 shows how a cleaning blade of a cleaning device, which is shown in FIG. 2, contacts the intermediate transfer belt.

As shown in FIGS. 4A and 5, the fine particles transferred from the brush roller 38 to the belt 19 are considered to remain in a relatively irregular condition and have a relatively weak adhering force. It follows that as image formation is repeated, the particles on the belt 19 sequentially decrease, allowing the filming substance to deposit on the belt 19. Therefore, it is necessary to apply the particles to the belt 19 frequently. In light of this, the rubber blade **22*b* rubs the surface of the belt 19 carrying the agent thereon. A back-up roller 42 is located to face the rubber blade 22*b* with the intermediary of the belt 19, insuring the stable contact of the blade 22*b* with the belt 19. Although toner particles gather at the edge of the blade 22*b*, the particles of the agent, which are far smaller than the toner particles, are allowed to reach the edge of the blade 22*b* through the aggregation of the toner particles. The particles of the agent gathered at the blade edge can pass through the small gap between the belt 19 and the blade edge. Such particles are rubbed against the surface of the belt 19 passing through the above-mentioned gap and, as a result, adhere to the belt 19 intensely in a uniform distribution. In FIG. 5**, the toner particles and the agent particles are labeled T and B, respectively.

Experiments showed that when the agent was simply applied to the belt 19 by the brush roller 38, the effect of the agent lasted for only about twenty copies. By contrast, when the agent was applied by the brush roller 38 and then rubbed by the blade **22*b***, the effect lasted for about 100 copies.

The timing (interval) for applying the agent to the belt 19 is controlled as follows. If the agent is applied to the belt 19 in an excessive amount, the parting ability of the surface of the belt 19 is excessively enhanced to degrade the transfer ratio from the drum 9 to the belt 19. In light of this, a particular number of copies is set beforehand. Then, the application of the agent is effected at the end of a series of continuous image formation during which the cumulative number of copies after the last application has exceeded a predetermined number, or between copying cycles during which the number of copies continuously produced has exceeded a predetermined number. This is successful in minimizing the number of times that the copying operation is interrupted due to the application and, therefore, in insuring efficient copying operation. For example, assume that the maximum number of copies to be set in an ordinary copy mode is ninety-nine. Then, the application may be executed at the end of a series of continuous copying cycles effected after the cumulative number of copies has exceeded fifty. Under these conditions, the application will occur once for 148 copies (49+99) at maximum. On the other hand, when an automatic document feeder (ADF) and a sorter are used, more than ninety-nine copies can be continuously produced, so that the application only at the end of a series of copying cycles will not suffice. To confine the amount of deposition of the agent in a sufficient range even in such a case, the application is effected between the production of the 150th copy and that of the 151st copy in a repeat copy mode. It should be noted that the specific numbers mentioned above, i.e., fifty and 150 depend on, for example, the conditions for the application of the agent.

Figure 6:
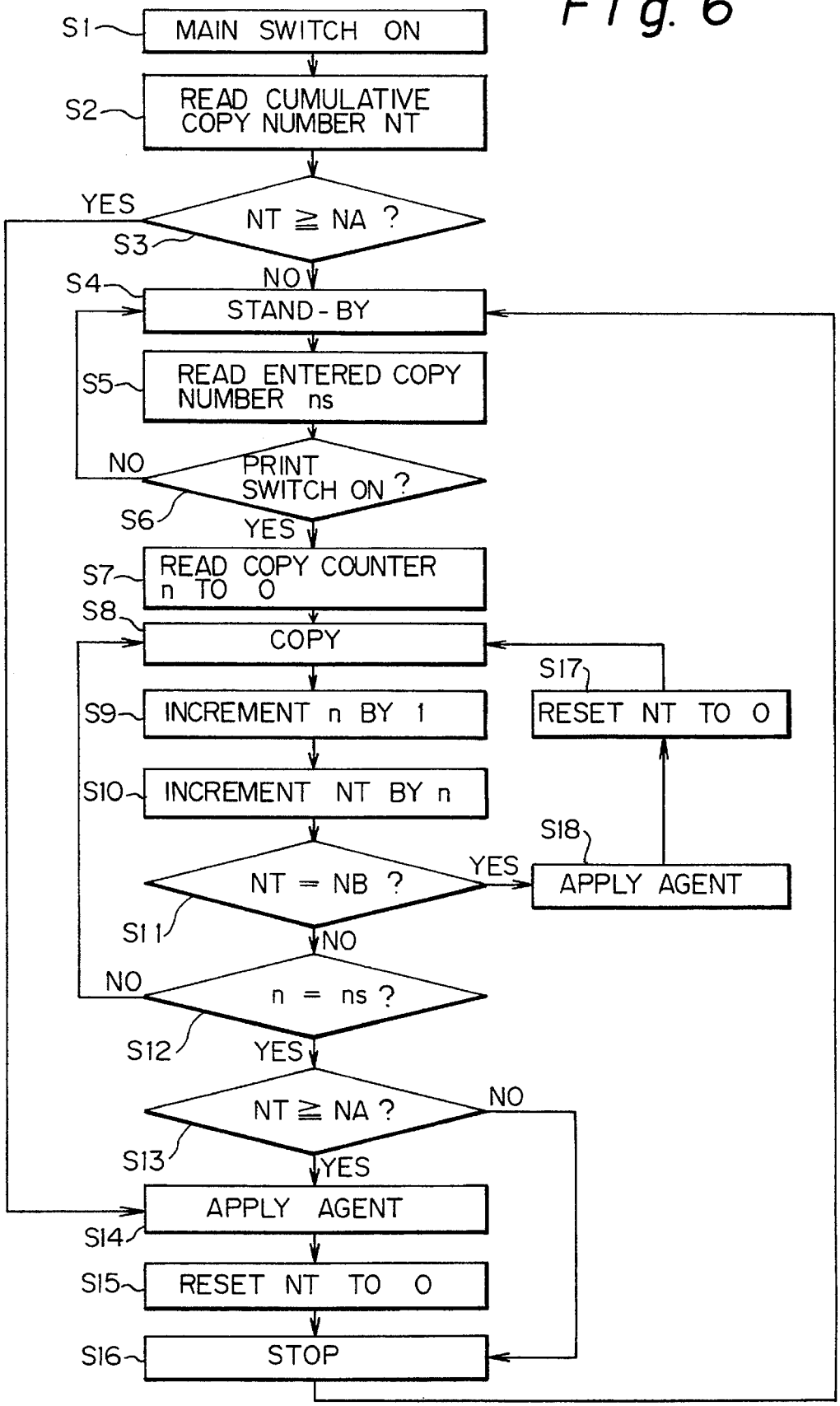
FIG. 6 is a flowchart representative of a specific operation of the applying device.

Referring to FIG. 6, a specific procedure for controlling the application timing will be described. As shown, when a main switch provided on the copier is turned on (step S1), a controller, not shown, reads the content NT of a cumulative copy counter storing the cumulative number of copies produced after the last application of the agent (step S2). Then, the controller determines whether or not the number NT is greater than or equal to a first reference copy number NA (fifty in the above conditions) (step S3). If the answer of the step S3 is positive, Yes, the controller executes the application of the agent to the belt 19 (step 14), resets the copy counter to zero (step S15), and then stops the movement of the belt 19 and other movable members (step S16). The step S16 is followed by a step S4. On the other hand, if the number NT is smaller than the number NA (No, step S3), the controller holds the copier in a stand-by state (step S4), reads the number of copies ns entered on, for example, numeral keys provided on the operation board, not shown (step S5), and then awaits the depression of a copy start button (or print switch) (step S6).

When the copy start button is pressed (Yes, step S6), the controller resets the content n of a copy counter to zero (step S7), effects a copying cycle, increments the content n of the copy counter and the content NT of the cumulative copy counter (steps S9 and S10), and then compares the resulting content NT of the cumulative copy counter with a second reference copy number NB (150 in the above conditions) (step S11). If the number NT is not equal to the number NB (No, step S11), the controller compares the content n of the copy counter with the entered copy number ns to see if all the desired number of copies n have been produced (step S12). Thereafter, until the desired number of copies n have been produced (Yes, step S12) or the content NT of the cumulative copy counter coincides with the second reference copy number NB, the controller repeats the copying cycle while incrementing the counters.

On determining that the desired number of copies n have been produced (Yes, step S12), the controller compares the content NT of the cumulative copy counter with the first reference copy number NA (step S13). If the number NT is greater than or equal to the number NA (Yes, step S13), the controller executes the application of the agent (step S14), resets the content NT of the cumulative copy counter to zero (step S15), and then stops the movement of the belt 19 and other movable members (step S16). On the other hand, if the content NT of the cumulative copy counter is smaller than the first reference copy number NA (No, step S13), the controller directly stops the movement of the belt 19 (step S16). When the content NT is equal to the second reference copy number NB (Yes, step S11), as determined during a series of copying cycles, the controller executes the application of the agent immediately (step S18), resets the counter NT to zero (step S17), and then resumes the copying operation (step S8).

In the procedure described above, the cumulative copy counter is reset when the application of the agent completes, and the counter and the first reference copy number are compared after the turn-on of the main switch to see if application is necessary or not. Hence, when the copier is forced to stop operating during the course of application due to a jam or the turn-off of the power source, the application can be resumed when, for example, the power source is turned on again.

With the construction and operation stated above, the embodiment is capable of maintaining the amount of deposition of the agent on the belt 19 in a predetermined range over a long period of time. If the drive means for the brush roller 38 is constructed to drive the roller 38 such that the periphery of the roller 38 and the surface of the belt 19 run in the same direction when contacting each other, the drive means will be freed from heavy loads and, therefore, reduced in size. While the embodiment is practicable with various kinds of agents, the agent whose major component is zinc stearate eliminates irregularities in transfer efficiency ascribable to irregular application.

Image forming apparatus of the type having an intermediate transfer belt as described above, the materials constituting a photoconductive element, belt, and recording medium have to be adequately selected in respect of coefficient of friction; otherwise, defective image transfer is apt to occur. For example, so long as an image is transferred from a surface having a small coefficient of friction to a surface having a great coefficient of friction, the transfer is successful. However, when an image is transferred from the latter surface to the former surface, defective image transfer, i.e., local omission of a character image is likely to occur.

In light of the above, the embodiment forms the drum 9, belt 19 and paper sheet 24 of out of materials satisfying the following relation:

$$\alpha \leqq \beta \leqq \gamma$$

where $\alpha$ is a relative coefficient of friction between the drum 9 and a body to make frictional contact with the drum 9 (i.e. the other object assumed in the event of discussing a coefficient of friction), $\beta$ is a relative coefficient of friction between the belt 19 and body identical with the above-mentioned body, and $\gamma$ is a relative coefficient of friction between the paper sheet 24 and a body identical with the same body. Specifically, the materials of the drum 9, belt 19 and paper sheet 24 are selected, or the coefficients of friction thereof are adjusted, in such a manner as to satisfy the above relation Typical of the materials available for the drum 9 are amorphous silicone, organic photoconductors (OPC), and selenium. For the belt 19, use is made of, for example, elastic rubber, polycarbonate resin or similar material having a medium resistance (about $1\times10^8$ Ωcm). Such a material will facilitate the deposition of a charge from above an image or implement self-discharge without using a discharger.

The materials available for the drum 9 each has a particular coefficient of friction, as follows:

| | |
|---|---|
| (1) A—Si (amorphous silicone) | about 0.7 |
| (2) overcoated selenium drum | 0.8–0.9 |
| (3) OPC (organic photoconductor) | 1.0–1.2 |
| (4) selenium drum | 1.2–1.4 |

It should be noted that such coefficients of friction hold when the materials contact the same kind of body.

Regarding the belt 19, the coefficients of frictions are as follows:

| | |
|---|---|
| (1) elastic rubber with Teflon or similar coating | 0.6–1.0 |
| (2) polycarbonate | 1.0–1.4 |

If the materials of the drum 9 and belt 19 are so selected as to satisfy the relation $\alpha \leqq \beta \leqq \gamma$ while taking account of the coefficient of friction of the paper sheet 24, image quality will be further enhanced with defective image transfer reduced.

However, it may occur that the materials satisfying the above relation cannot be used. For example, materials resulting in a relation $\alpha>\beta$, but not in $\alpha<\beta$, may have to be used due to various limitations. In such a case, the embodiment applies the lubricating oil additive to, for example, the drum 9 for thereby reducing the coefficient of friction of the drum 9. Then, the relation $\alpha<\beta$ holds; even when $\alpha$ is equal to $\beta$, a better result is achievable than when the agent is not applied at all.

Lubricating oil additives applicable to the embodiment include zinc stearate, iron stearate, barium stearate, nickel stearate, cobalt stearate, copper stearate, strontium stearate, calcium stearate, cadmium stearate, magnesium stearate, cobalt oleate, zinc oleate, manganese oleate, iron oleate, zinc palmitate, cobalt palmitate, copper palmitate, magnesium palmitate, aluminum palmitate, calcium palmitate, zinc caprylate, copper caprylate, linolenic acid zinc, linolenic acid cobalt, linolenic acid calcium, and other metal salts of fatty acids; and candelilla wax, carnauba wax, rice wax, vegetable wax, bees wax, hydrous lanolin, and other waxes.

Figure 7:
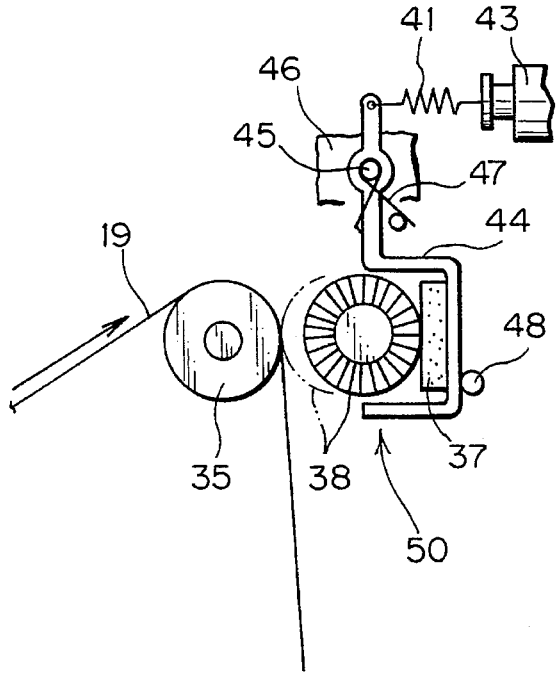
FIG. 7 is a section showing another specific construction of the applying device which is used to set up a particular relation between a photoconductive element, the intermediate transfer belt, and a recording medium with respect to the coefficient of friction.

FIG. 7 shows a device 50 for applying such a lubricating oil additive to the belt 19 and which is similar to the previously described applying device 36. As shown, a member 44 carrying the agent 37 and brush roller 38 thereon is rotatably connected to a base plate 46 by a pin 45. The member 44 is constantly biased by a spring 47 to remain in abutment against a stop pin 48. A solenoid 43 is connected to the member 44 and causes, when energized, the member 44 to rotate clockwise about the pin 45 until the brush roller 38 contacts the belt 19. In this condition, the brush roller 38 is rotated in contact with the belt 19.

The applying device 50 applies the lubricating oil additive to the brush roller 38 which is in rotation. Then, the additive or agent is uniformly transferred from the brush roller 38 to the belt 19, thereby forming a thin film on the surface of the belt 19. Assume that the drum 9 and belt 19 are made of respective materials which set up a relation $\alpha>\beta$. Then, if a lubricating oil additive satisfying a relation $\alpha\leqq\beta$ is applied to the belt 19, the surfaces of the drum 9 and belt 19 can satisfy the relation $\alpha\leqq\beta$. Of course, coefficient of friction of the paper 24 should be taken into account.

The applying device 50 may be constructed to apply agent to the belt 19 during the interval between the transfer of a toner image from the belt 19 to the paper sheet 24 and the transfer of a toner image from the belt 19 to the next paper sheet, or at the end of a copying operation.

If desired, an applying device similar to the device 50 may be associated with the drum 9 to apply the same or a different lubricating oil additive to the drum 9. Alternatively, such a device may be associated with both the drum 9 and the belt 19. The gist is that the device 50 applies a lubricating oil additive to at least one of the drum 9 and belt 19 in order to set up the previously stated relation with respect to the coefficient of friction.

Assume that the applying device 50 contacts either the drum 9 or the belt 19 and applies a lubricating oil additive thereto, as stated above. Then, the drum 9 and belt 19 may each be driven at a particular linear velocity at the time of application in order to apply the additive to, for example, the belt 19 and then transfer it from the belt 19 to the drum 9. With this arrangement, it is possible to apply the same kind of additive to both the drum 9 and the belt 19 by a single applying device 50 associated with, for example, the belt 19. This is also true when a single device 50 is associated with the drum 9. As a result, the number of constituent parts and, therefore, the cost is reduced, and maintenance is facilitated.

To drive each of the drum 9 and belt 19 at a particular linear velocity, the belt 19, for example, may be driven at a linear velocity higher or lower than the linear velocity of the drum 9. Specifically, in the illustrative embodiment wherein the belt 19 is passed over the drive roller 21 and driven rollers 35 and 20, the rotation speed of the drive roller 21 may be changed at the time of application of the additive. Alternatively, the direction in which the belt 19 rotates may be reversed. Of course, only the linear velocity or the direction of rotation of the drum 9 may be changed.

Figure 8:
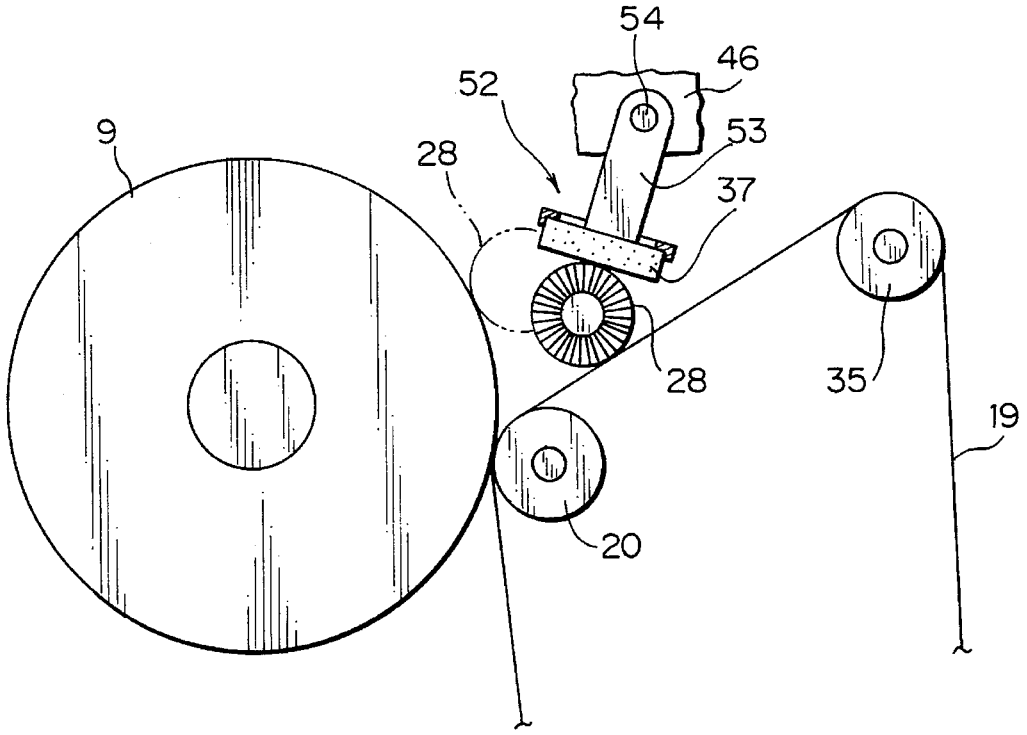
FIG. 8 is a section showing a modified form of the applying device of FIG. 7.

FIG. 8 shows another applying device 52 which is capable of selectively applying the lubricating oil additive to either the drum 9 or the belt 19, as needed. As shown, the device 52 has a member 53 carrying the base plate 46 carrying the agent 37 and brush roller 28 thereon. The member 53 is rotatably connected to the base plate 46 by a pin 54 and caused to rotate by a solenoid or similar actuating means, not shown. In this construction, the device 52 is capable of bringing the brush roller 28 into contact with the drum 9 or the belt 19, as needed. To apply the agent only to the drum 9, the brush roller 28 is caused to contact the drum 9, as indicated by a dash-and-dots line in the figure. On the other hand, to apply the agent only to the belt 19, the roller 28 is brought into contact with the belt 19, as indicated by a solid line in the figure. Further, to apply the agent to both the drum 9 and the belt 19, the roller 28 may be caused to contact them alternately.

In any case, the applying device 52 is movable to apply the agent to both the drum 9 and the belt 19. Therefore, the application can be implemented by a single device which enhances simple construction, reduces the number of parts and cost, and simplifies maintenance. It will be needless mention that the device 52 may be so constructed as to maintain the roller 28 in contact with the drum 9 and belt 19 at the same time.

In summary, it will be seen that the present invention provides an image forming apparatus having various unprecedented advantages, as enumerated below.

(1) The apparatus prevents a toner, which is transferred to an intermediate image carrier thereof, from adhering to the image carrier intensely and allows a cleaning device thereof to remove toner easily. Hence, the apparatus can obviate toner filming without an occurrence that the intermediate image carrier is excessively rubbed by a cleaning roller to, in turn, change image transfer ability and lower image quality, which occurrence is particular to, for example, the previously stated Laid-Open Publication No. 2-214882. Moreover, the generation of a filming layer is little susceptible to the conditions in which the apparatus is used, and therefore the apparatus is more adaptive to the environment than, for example, the apparatus taught in the above Laid-Open Publication.

(2) An agent produced by solidifying fine particles is shaved off and then applied to the surface of the intermediate image carrier. This allows a simple agent accommodating mechanism and constant amount application mechanism to apply the agent stably, compared to the previously discussed Laid-Open Publication No. 3-65973 which discloses an apparatus of the type accommodating and applying an gent in the form of particles. In addition, with the apparatus of the present invention, it is relatively easy to replenish the agent to the apparatus.

(3) The agent is applied only to an area of the intermediate image carrier which has been cleaned by a cleaning device. This reduces the contamination of the applying device due to a toner, compared to a case wherein the agent is applied to the surface of the image carrier which has not been cleaned. Further, a predetermined cleaning device is used and caused to perform a cleaning operation until at least a predetermined portion of the surface of the image carrier carrying the fine particles thereon moves away from the cleaning device. Hence, the particles can deposit on the image carrier uniformly and intensely. The intense adhesion of the particles to the image carrier is not attainable with the Laid-Open Publication No. 3-65973 which implements the cleaning device with a fur brush roller.

(4) Assume that the applying device applies the agent when the cumulative number of image forming cycles after the last application of the agent exceeds a predetermined number when a certain series of image forming cycles are completed. Then, even in an image forming apparatus of the kind required to interrupt image formation for the application of the agent between consecutive image forming cycles, a certain degree of anti-toner filming effect can last over a long period of time without requiring the apparatus to interrupt image formation. On the other hand, when the applying device is so constructed as to apply, when the predetermined cumulative number of times of image forming cycles is reached, the agent between a series of consecutive image forming cycles, the anti-toner filming effect can be insured over a long period of time. Furthermore, assume that whether or not to apply the agent is determined between consecutive image forming cycles during a given image forming operation on the basis of a particular number of times which is greater than a particular number of times used to determine whether or not to apply the agent at the end of a series of image forming cycles. Then, usually, the agent may be applied only when the smaller reference number of times is reached at the end of a series of consecutive copying cycles; when the greater reference number of times is reached during the course of a great number of continuous copying cycles, the agent may be applied between the copying cycles to eliminate filming. This insures the anti-toner filming effect over a long period of time even in an image forming apparatus of the type required to interrupt the copying operation for the application of the agent.

(5) A particle carrying member is driven such that the surface thereof moves at a position where the member faces the intermediate image carrier. Since such a member applies the fine particles to the surface of the image carrier, the device for application is simple and is operable stably. Further, since the surface of the particle carrying member moves in the same direction as the surface of the image carrier at the position where the member faces the image carrier, a minimum of load acts on a drive source, compared to a case wherein the member is moved in the other direction.

(6) The particles are implemented by a substance whose major component is zinc stearate. Hence, the particles can be applied in a desirable manner with a minimum of irregularity.

(7) Assume that when the apparatus is reset after a paper jam and/or has a main switch thereof turned on, the cumulative number of image forming cycles after the last application of the agent is greater than a reference number. Then, the applying device performs application. Hence, even when the application is interrupted due to the detection of a paper jam or the manual turn-off of the main switch, it can be surely completed when the apparatus is reset again after jam processing or when the main switch is turned on again.

(8) When a toner image is sequentially transferred from a latent image carrier to a recording medium via the intermediate image carrier, defective image transfer, including local omission of a character image, is reduced, thereby further enhancing image quality.

(9) A particular relation in the coefficient of friction can be set up between the latent image carrier, intermediate image carrier and recording medium without being restricted by the materials of such members.

(10) A single applying device suffices and, therefore, simplifies the overall construction, reduces the number of parts, saves cost and space, and facilitates maintenance.

Various modifications will become possible for those skilled in the art after receiving the teachings of the present disclosure without departing from the scope thereof.

What is claimed is:

1. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to one of a final toner image carrier and another intermediate image carrier;

a cleaning device for removing a toner remaining on said intermediate image carrier; and an applying device for applying to a surface of said intermediate image carrier fine particles capable of preventing toner filming from occurring;

said applying device including an applicator and means for moving said applicator between a contact position at which said applicator contacts said intermediate image carrier and a non-contact position at which said applicator is spaced from said intermediate image carrier;

the apparatus further comprising control means for controlling said cleaning device and said applying device such that said fine particles are applied only to an area of the surface of said intermediate image carrier from which said cleaning device has removed the toner.

2. An apparatus as claimed in claim 1, wherein said applying device comprises an agent formed by solidifying said fine particles, and applying means for transforming said agent to said fine particles and applying said fine particles to the surface of said intermediate image carrier.

3. An apparatus as claimed in claim 1, wherein an applicator of said applying device comprises a particle carrying member driven such that a surface of said particle carrying member moves in a same direction as the surface of said intermediate image carrier at a position where said particle carrying member faces said intermediate image carrier.

4. An apparatus as claimed in claim 1, wherein said fine particles comprise particles of a substance whose major component is zinc stearate.

5. The apparatus of claim 1, wherein said applying device includes a brush which shaves said fine particles from a supply source.

6. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to one of a final toner image carrier and another intermediate image carrier;

a cleaning device for removing a toner remaining on said intermediate image carrier; and an applying device for applying to a surface of said intermediate image carrier fine particles capable of preventing toner filming from occurring;

the apparatus further comprising control means for controlling said cleaning device and said applying device such that said fine particles are applied to only an area of the surface of said intermediate image carrier from which said cleaning device has removed the toner, and such that said cleaning device continuously operates until at least a predetermined portion of said surface to which said fine particles have been applied moves away from a position where said intermediate image carrier faces said cleaning device.

7. An image forming apparatus comprising: an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to one of a final toner image carrier and another intermediate image carrier;

a cleaning device for removing a toner remaining on said intermediate image carrier; and an applying device for applying to a surface of said intermediate image carrier fine particles capable of preventing toner filming from occurring;

the apparatus further comprising control means for causing, when said apparatus is reset after jam processing or when a power source of said apparatus is turned on, said applying means to apply said fine particles if a cumulative number of image forming cycles after a last application is greater than a predetermined number of times.

8. An image forming apparatus comprising:

an image carrier rotatable for forming a toner image on a surface thereof; and an intermediate image carrier rotatable in contact with said image carrier for causing the toner image to be transferred from said image carrier to a surface of said intermediate image carrier at a position where said intermediate image carrier contacts said image carrier, said toner image on said intermediate image carrier being transferred to a recording medium;

said image carrier, said intermediate image carrier and said recording medium having respective surfaces conditioned to satisfy a relation:

$$\alpha \leqq \beta \leqq \gamma$$

where $\alpha$ is a relative coefficient of friction between said image carrier and a body frictionally contacting said image carrier, $\beta$ is a relative coefficient of friction between said intermediate image carrier and and a body identical with said body, and $\gamma$ is a relative coefficient of friction between said recording medium and a body identical with said body.

9. An apparatus as claimed in claim 8, further comprising applying means for applying a lubricating oil additive to at least one of said image carrier and said intermediate image carrier, thereby setting up said relation.

10. An apparatus as claimed in claim 9, wherein said applying means is movable for selectively applying the lubricating oil additive to said image carrier and said intermediate image carrier, as needed.

11. An apparatus as claimed in claim 9, wherein said applying means applies the lubricating oil additive to one of said image carrier and said intermediate image carrier in contact therewith, said image carrier and said intermediate image carrier being each rotated at a particular speed in the event of application of said lubricating oil additive.

12. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to one of a final toner image carrier and another intermediate image carrier;

a cleaning device for removing a toner remaining on said intermediate image carrier; and an applying device for applying to a surface of said intermediate image carrier fine particles capable of preventing toner filming from occurring;

said applying device including an applicator and means for moving said applicator between a contact position at which said applicator contacts said intermediate image carrier and a non-contact position at which said applicator is spaced from said intermediate image carrier;

wherein said applying device includes a brush which shaves said fine particles from a supply source, and wherein said supply source includes a solid mass of said fine particles, said applying means further including means for limiting a spacing between said brush and said solid mass.

13. The apparatus of claim 12, wherein said brush is a rotary brush, and said means for limiting a spacing includes a roller.

14. The apparatus of claim 13, wherein said rotary brush includes a brush shaft, and wherein said roller is mounted upon said brush shaft, said roller having a diameter smaller than an outer diameter of said rotary brush.

15. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to one of a final toner image carrier and another intermediate image carrier;

a cleaning device for removing a toner remaining on said intermediate image carrier; and an applying device for applying to a surface of said intermediate image carrier fine particles capable of preventing toner filming from occurring;

said applying device including an applicator and means for moving said applicator between a contact position at which said applicator contacts said intermediate image carrier and a non-contact position at which said applicator is spaced from said intermediate image carrier;

wherein said means for moving said applicator moves said applicator to a position at which said applicator contacts said image carrier and applies the fine particles to said image carrier.

16. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to a final toner image carrier;

a cleaning device for removing a toner remaining on said intermediate image carrier; and an applying device having an applicator for applying fine particles to a surface of said intermediate image carrier;

wherein said applying device comprises moving means for moving said applicator between a contact position at which said applicator contacts said intermediate image carrier and a non-contact position at which said applicator is spaced from said intermediate image carrier and limiting means for limiting an amount which said applicator bites into said intermediate image carrier when said applicator contacts said intermediate image carrier at the contact position.

17. An image forming apparatus as claimed in claim 16, wherein said applicator comprises a brush rotatable about a shaft, and said limiting means is mounted on opposite ends of said brush shaft.

18. An image forming apparatus as claimed in claim 16, wherein said applying device comprises an agent formed by solidifying said fine particles and transforming means for transforming said agent to said fine particles to apply said fine particles to the surface of said intermediate image carrier.

19. An image forming apparatus as claimed in claim 16, wherein said applicator of said applying device comprises a particle carrying member driven such that a surface of said particle carrying member moves in a same direction as the surface of said intermediate image carrier at a position where said particle carrying member faces said intermediate image carrier.

20. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to a final toner image carrier;

a cleaning device for removing a toner remaining on said intermediate image carrier;

cleaning device moving means for moving said cleaning device into and out of contact with said intermediate image carrier;

an applying device for applying to a surface of said intermediate image carrier fine particles;

applying device moving means for moving said applying device into and out of contact with said intermediate image carrier; and control means for controlling said cleaning device moving means and said applying device moving means such that said applying device contacts an area of the surface of said intermediate image carrier from which said cleaning device has removed the toner when said cleaning device contacts said area of the surface of said intermediate image carrier.

21. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to a final toner image carrier;

a cleaning device for removing a toner remaining on said intermediate image carrier;

cleaning device moving means for moving said cleaning device into and out of contact with said intermediate image carrier;

an applying device for applying to a surface of said intermediate image carrier fine particles;

applying device moving means for moving said applying device into and out of contact with said intermediate image carrier; and control means for controlling said cleaning device moving means and said applying device moving means such that said cleaning device is maintained in contact with said intermediate image carrier until a portion of the surface of said intermediate image carrier to which said fine particles have been applied by said applying device is moved away from said cleaning device.

22. An image forming apparatus comprising:

an image carrier for carrying a toner image formed by developing a corresponding latent image;

an intermediate image carrier for carrying the toner image transferred from said image carrier;

first image transferring means for transferring the toner image from said image carrier to said intermediate image carrier;

second image transferring means for transferring the toner image from said intermediate image carrier to a final toner image carrier;

a cleaning device for removing a toner remaining on said intermediate image carrier;

an applying device for applying to a surface of said intermediate image carrier fine particles; and control means for causing, when said apparatus is reset after jam processing or when a power source of said apparatus is turned on, said applying means to apply said fine particles if a cumulative number of image forming cycles after a last application is greater than a predetermined number.

23. An image forming method comprising the steps of:

(a) forming a developed image on an image carrier;

(b) transferring said developed image from said image carrier to an intermediate image carrier;

(c) transferring said developed image from said intermediate image carrier to a final image carrier;

(d) removing part of said developed image remaining on said intermediate image carrier; and (e) applying fine particles to only a part of a surface of said intermediate image carrier from which part said developed image has been removed.

24. An image forming method comprising the steps of:

(a) forming a developed image on an image carrier;

(b) transferring said developed image from said image carrier to an intermediate image carrier;

(c) transferring said developed image from said intermediate image carrier to a final image carrier;

(d) applying fine particles to a surface of said intermediate image carrier; and (e) rubbing an entire area of said surface of said intermediate image carrier to thereby uniformly deposit said fine particles thereon.

25. An image forming apparatus comprising:

an image carrier rotatable for forming a toner image on a surface thereof; and an intermediate image carrier rotatable in contact with said image carrier for causing the toner image to be transferred from said carrier to a surface of said intermediate image carrier at a position where said intermediate image carrier contacts said image carrier, said toner image on said intermediate image carrier being transferred to a recording medium;

said image carrier and said intermediate image carrier having respective surfaces conditioned to satisfy a relation:

$$\alpha \leqq \beta$$

where $\alpha$ is a relative coefficient of friction between said image carrier and a body frictionally contacting said image carrier, and $\beta$ is a relative coefficient of friction between said intermediate image carrier and a body identical with said body.

* * * * *